US006412704B2

(12) United States Patent
Shinogle et al.

(10) Patent No.: US 6,412,704 B2
(45) **Date of Patent: *Jul. 2, 2002**

(54) FUEL INJECTOR WITH RATE SHAPING CONTROL THROUGH PIEZOELECTRIC NOZZLE LIFT

(75) Inventors: Ronald D. Shinogle, Peoria; Senthilkumar Rajagopalan, Bloomington, both of IL (US)

(73) Assignee: Caterpillar Inc., Peoria, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/561,715

(22) Filed: May 1, 2000

Related U.S. Application Data

(63) Continuation of application No. 09/170,420, filed on Oct. 13, 1998, now Pat. No. 6,079,641.

(51) Int. Cl.[7] ..... F02M 45/00

(52) U.S. Cl. ..... 239/5; 239/96; 239/533.4; 239/533.8; 239/533.9; 239/584; 251/129.06

(58) Field of Search ..... 239/88, 92, 96, 239/124, 127, 533.2, 533.8, 533.9, 102.1, 102.2, 584, 533.4, 585.1, 5, 533.3, 533.5; 251/57, 129.06; 123/458, 496, 498; 310/316, 317, 314, 323.17

(56) References Cited

U.S. PATENT DOCUMENTS

| | | | | |
|---|---|---|---|---|
| 3,995,813 A | * | 12/1976 | Bart et al. | 239/584 |
| 4,649,886 A | * | 3/1987 | Igashira et al. | 239/584 X |
| 4,720,077 A | | 1/1988 | Mihoura et al. | |
| 4,728,074 A | * | 3/1988 | Igashira et al. | 251/57 |
| 4,784,102 A | * | 11/1988 | Igashira et al. | 239/88 X |
| 4,909,440 A | * | 3/1990 | Mitsuyasu et al. | 239/533.9 X |

(List continued on next page.)

FOREIGN PATENT DOCUMENTS

| | | |
|---|---|---|
| DE | 4434892 A1 | 4/1996 |
| EP | 61271881 | 2/1986 |
| EP | 61271881 | 12/1986 |
| EP | 0826876 A1 | 3/1998 |
| EP | 0 826 876 A1 | 4/1998 |
| EP | 0971119 A2 | 1/2000 |

OTHER PUBLICATIONS

English language translation of German Patent DE 4434892 A1.

*Primary Examiner*—Steven J. Ganey
(74) *Attorney, Agent, or Firm*—Liell & McNeil; Michaeel B. McNeil

(57) ABSTRACT

A fuel injector includes an injector body that defines a nozzle outlet. A needle valve member is mounted in the injector body and moveable a lift distance between an open position in which the nozzle outlet is open, and a closed position in which the nozzle outlet is blocked. A piezoelectric actuator is mounted in the injector body and is moveable a piezo distance between an off position and an on position. A coupling linkage interconnects the needle valve member to the piezoelectric actuator such that a movement of the piezoelectric actuator is multiplied into a larger movement of the needle valve member.

20 Claims, 2 Drawing Sheets

U.S. PATENT DOCUMENTS 5,057,734 A 10/1991 Tsuzuki et al.
5,080,079 A * 1/1992 Yoshida et al. ..... 239/585.1 X
5,130,598 A * 7/1992 Verheyen et al. ..... 310/316
5,186,151 A 2/1993 Schwerdt et al.
5,237,968 A * 8/1993 Miller et al. ..... 123/498 X
5,361,014 A * 11/1994 Antone et al. ..... 123/498 X
5,452,858 A * 9/1995 Tsuzuki et al. ..... 239/533.8
5,477,831 A * 12/1995 Akaki et al. ..... 123/490
5,479,902 A * 1/1996 Wirbeleit et al. ..... 123/498
5,482,213 A * 1/1996 Matsusaka et al. ..... 239/584
5,605,134 A 2/1997 Martin
5,694,903 A 12/1997 Ganser
5,697,554 A * 12/1997 Auwaerter et al. ..... 239/584 X
5,779,149 A * 7/1998 Hayes, Jr. ..... 239/533.9 X
5,860,597 A * 1/1999 Tarr ..... 239/533.3 X
5,884,848 A * 3/1999 Crofts et al. ..... 239/533.4 X
5,979,803 A * 11/1999 Peters et al. ..... 239/533.4
6,079,641 A * 6/2000 Shinogle et al. ..... 239/533.4

* cited by examiner 21
13
22
12
20
10
30
28
15
23
31
26
25
27
17
11
18
47
44
42
15
41a
40
41b
16
45
14
43

FUEL INJECTOR WITH RATE SHAPING CONTROL THROUGH PIEZOELECTRIC NOZZLE LIFT

RELATION TO A PRIOR APPLICATION

This application is a continuation of application Ser. No. 09/170,420, filed on Oct. 13, 1998, now U.S. Pat. No. 6,079,641.

TECHNICAL FIELD

The present invent relates generally to fuel injectors, and more particularly to fuel injectors that include a piezoelectric actuator.

BACKGROUND ART

Although there exists a wide variety of mechanisms for pressurizing fuel in fuel injection systems, almost all fuel injectors include a spring biased needle check valve to open and close the nozzle outlet. In almost all fuel injectors, the needle valve member is only stoppable at two different positions: fully open or fully closed. Because the needle valve members in these fuel injectors are not stoppable at a partially open position, fuel injection mass flow can only be controlled through changes in fuel pressure.

Over time, engineers have come to recognize that undesirable exhaust emissions can be reduced by having the ability to produce at least three different rate shapes across the operating range of a given engine. These rate shapes include a ramp, a boot shape and square fuel injection profiles. In addition to these rate shapes, there is often a need for the injector to have the ability to produce split injections in order to further improve combustion efficiency at some operating conditions, such as at idle. While some fuel injectors have the ability to produce split injections and produce some rate shaping, a fuel injector that can reliably produce all of these rate shaping effects remains somewhat elusive.

While it has been proposed in the art that piezoelectric actuators could be employed in fuel injection systems, the use of piezoelectric actuators to directly control needle lift has proven somewhat problematic. First, this is due in part to the fact that only so much space is available within a fuel injector to place a piezoelectric crystal stack. Given the space limitations, the maximum piezoelectric deformation possible in the space available is generally on the order of less than about one hundred microns. Since typical needle valve lifts are on the order of several hundreds of microns, direct piezoelectric control of needle valve lift is not realistic without making substantial—and likely unrealistic—changes in the nozzle area of a fuel injector.

The present invention is directed to overcoming these and other problems associated with the use of piezoelectric actuators in controlling needle valve lift within fuel injectors.

DISCLOSURE OF THE INVENTION

In one aspect, a fuel injector includes an fuel injector body that defines a nozzle outlet. A needle valve member is mounted in the injector body and moveable a lift distance between an open position in which the nozzle outlet is open, and a closed position in which the nozzle outlet is blocked. A piezoelectric actuator mounted in the injector body is moveable a piezo distance between an off position and an on position. A coupling linkage interconnects the needle valve member to the piezoelectric actuator, and multiplies movement of the piezoelectric actuator into a larger movement of the needle valve member.

In another aspect, a fuel injector includes an injector body that defines a nozzle outlet. A needle valve member is movably mounted in the injector body. A piezoelectric actuator is movably mounted in the injector body. A coupling linkage interconnects the needle valve member to the piezoelectric actuator, and multiplies the movement of the piezoelectric actuator into a larger movement of the needle valve member. A flow area past the needle valve member to the nozzle outlet is a function of a voltage applied to the piezoelectric actuator.

BEST MODE FOR CARRYING OUT THE INVENTION

Figure 1:
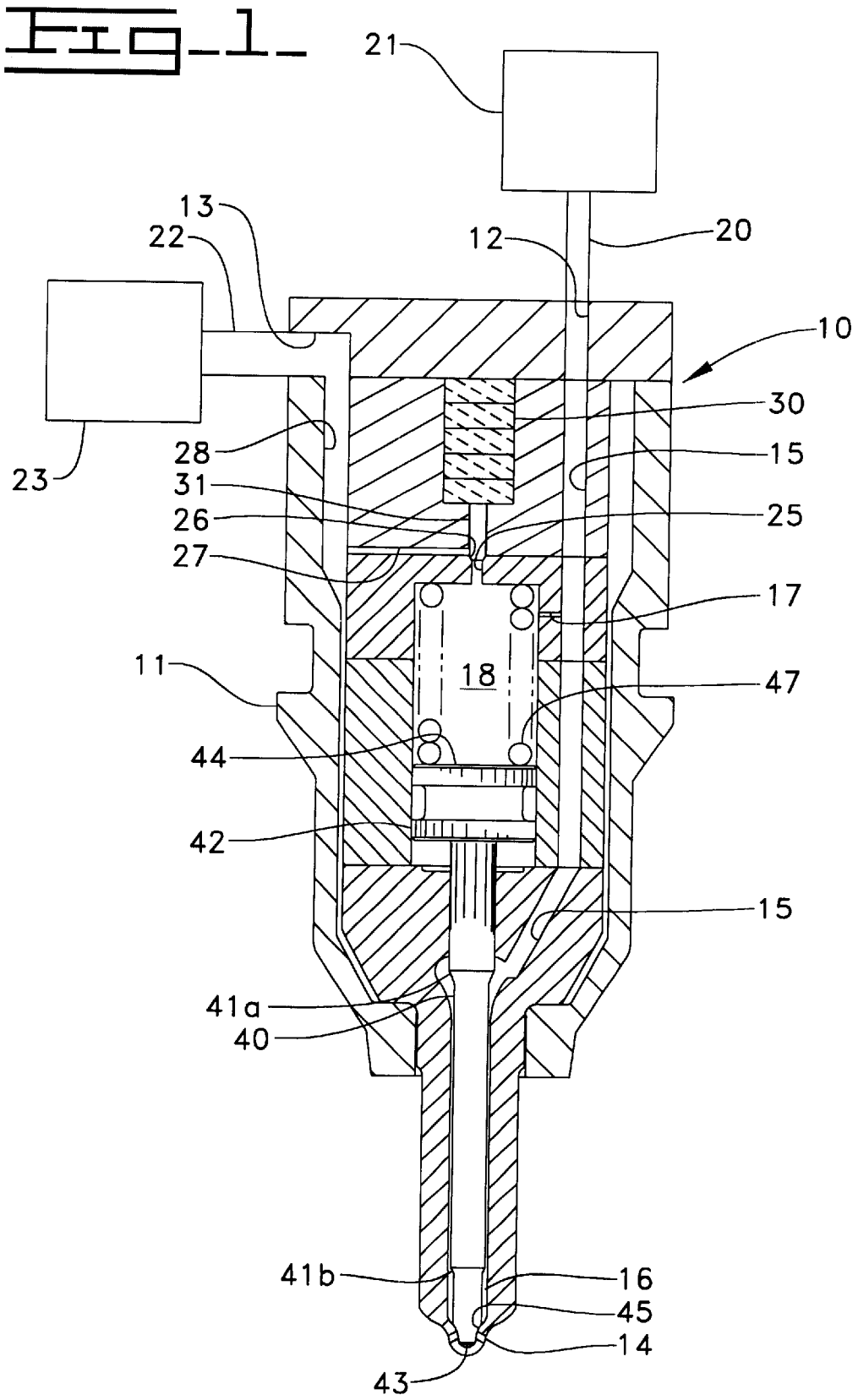
FIG. 1. is a sectioned side diagrammatic view of a fuel injector according to the present invention.

Referring now to FIG. 1, a fuel injector 10 includes an injector body 11 made up of various components attached together in a manner well known in the art. Injector body 11 defines a high pressure inlet 12 connected to a source of high pressure fuel 21 via a high pressure supply passage 20. Injector body 11 also defines a low pressure return drain 13 connected to a drain return reservoir 23 via a drain passage 22. Fuel injector 10 is preferably mounted in an internal combustion engine in a conventional manner, such as being positioned so that nozzle outlet 14 is in the combustion space, in the case of a diesel type engine.

In order to control the opening and closing of nozzle outlet 14, a needle valve member 40 is movably positioned in injector body 11. Needle valve member 40 is normally biased downward by a compression spring 47 to a position in contact with needle seat 45 to close nozzle outlet 14. Needle valve member 40 includes first and second outer lifting hydraulic surfaces 41*a* and 41*b* exposed to fluid 5 pressure in nozzle chamber 16, and in inner lift in g hydraulic surface 43 exposed to fluid,.pressure in the space between needle seat 45 and nozzle outlet 14. Nozzle chamber 16 is connected to the high pressure inlet 12 via a nozzle supply passage 15. In addition to lifting hydraulic surfaces 41*a*, 41*b* and 43, needle valve member 40 includes a closing hydraulic surface 44 located on the upper side of a piston portion 42 of the needle valve member. Closing hydraulic surface 44 is exposed to the fluid pressure in a needle control chamber 18, which is defined by injector body 11. Needle control chamber 18 is connected to nozzle supply passage 15 via a branch passage 17.

Needle control chamber 18 is also connected to a low pressure area 28 via a drain return passage 27 and an outlet control passage 25. Drain return passage 27 and outlet control passage 25 are separated by a valve seat 26. Low pressure area 28 is connected to low pressure return drain 13 as shown. In order to control the flow of fuel from needle control chamber 18 into outlet control passage 25, a piezoelectric actuator 30 is mounted in injector body 11 and operably attached to a control valve member 31. Piezoelectric actuator 30 moves control valve member 31 with respect to valve seat 26 to open and close outlet control passage 25.

When no voltage is applied to piezoelectric actuator 30, control valve member 31 is pushed into contact with seat 26 to close control outlet passage 25. When a voltage is applied to the piezoelectric crystal stack, the crystal(s) deform and move control valve member 31 out of contact with valve seat 26. Those skilled in the art will recognize that the distance that the control valve member 31 moves will be a function of voltage applied to piezoelectric actuator 30. This distance will in turn determine the flow area past seat 26 into drain return passage 27.

By having the ability to control the flow area past seat 26, the fluid pressure within needle control chamber 18 can be controlled relative to the relatively high pressure existing in nozzle supply passage 15. This is accomplished at least in part by properly sizing the flow area through branch passage 17 such that the fluid pressure in needle control chamber 18 is always less than the fluid pressure in nozzle supply passage 15 when piezoelectric actuator 30 is energized and the control valve member 31 is at least partially opened. When piezoelectric actuator 30 is de-energized so that seat 26 is closed, the fluid pressure in needle control chamber 18 is the same as that in nozzle supply passage 15.

Piezoelectric actuator 30 has the ability to control the lift of needle valve member 40 indirectly through the coupling linkage provided by the fluid pressure existing in needle control chamber 18. When actuator 30 is de-energized, outlet control passage 25 is closed and the needle valve member 40 is held in its downward closed position since the fluid pressure in needle control chamber 18 and nozzle supply passage is the same but the area of closing hydraulic surface 44 is much greater than the area of outer lifting hydraulic surfaces 41*a* and 41*b*. In order to lift needle valve member 40 upward to open seat 45 and allow fuel to spray out of nozzle outlet 14, there must be a net upward force on needle valve 40. In this embodiment, there are four different forces acting on needle valve member 40: a downward spring force from compression spring 47, a downward hydraulic force acting on closing hydraulic surface 44, an upward force acting on opening hydraulic surfaces 41*a* and 41*b* and an upward force acting on inner opening hydraulic surface 43. In order to stop needle valve member 40 at a partially opened position, these four forces must achieve an equilibrium.

The present invention has the ability to stop the needle valve member at a plurality of partially opened positions, between its closed position and a fully opened position, by adjusting the voltage on the piezoelectric actuator 30, which controls the fluid pressure in needle control chamber 18. An equilibrium at any partially opened position can be accomplished by knowing that the fluid pressure acting on inner opening hydraulic surface 43 is related to the flow area past seat 45 and hence the lift distance of needle valve member 40. The higher that the needle valve member 40 is lifted off of seat 45, the higher the pressure acting on inner lifting hydraulic surface 43. However, the higher the needle valve member 40 is lifted, the higher the spring force acting in a closing direction. Thus, by appropriately sizing compression spring 47 the area of closing hydraulic surface 44, the opening hydraulic surfaces 41*a* and 41*b* and 43 as well as the variable flow area past seat: 45, the flow area to nozzle outlet 14 can be made as a direct function of the voltage applied to piezoelectric actuator 30. Thus,the piezoelectric actuator 30 is able to indirectly control the lift distance of needle valve member 40 via the coupling linkage provided by needle control chamber 18. It should be pointed out, though, that the maximum lift distance of needle valve member 40 is many times the maximum movement distance of piezoelectric actuator 30 and control valve member 31. Thus, each movement of piezoelectric actuator 30 is multiplied into a larger movement of needle valve member 40.

INDUSTRIAL APPLICABILITY

Figure 2:
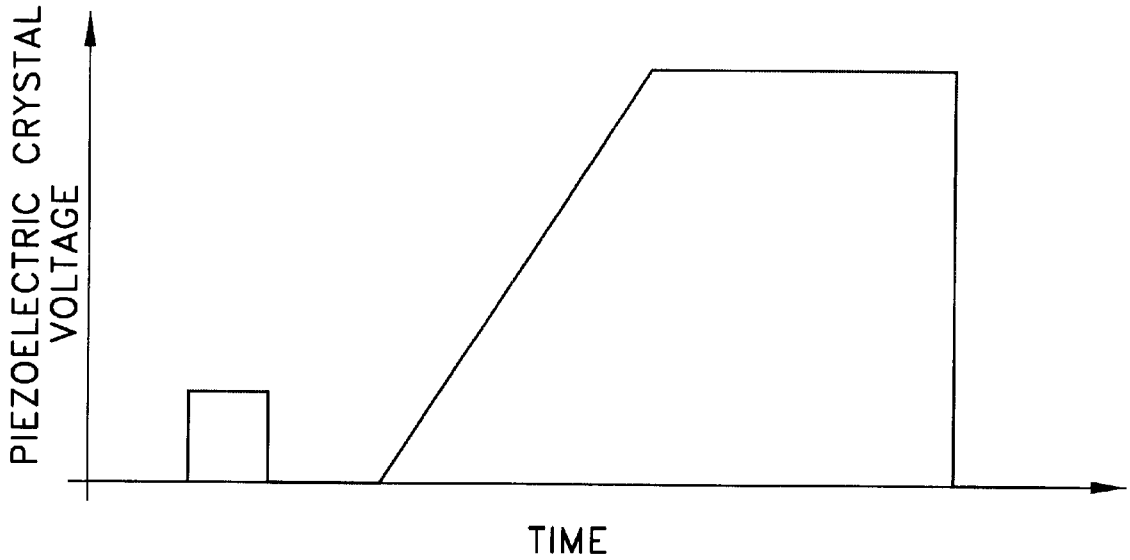
FIG. 2 is a graph of piezoelectric crystal voltage versus time for an example injection event according to one aspect of the present invention.
Figure 3:
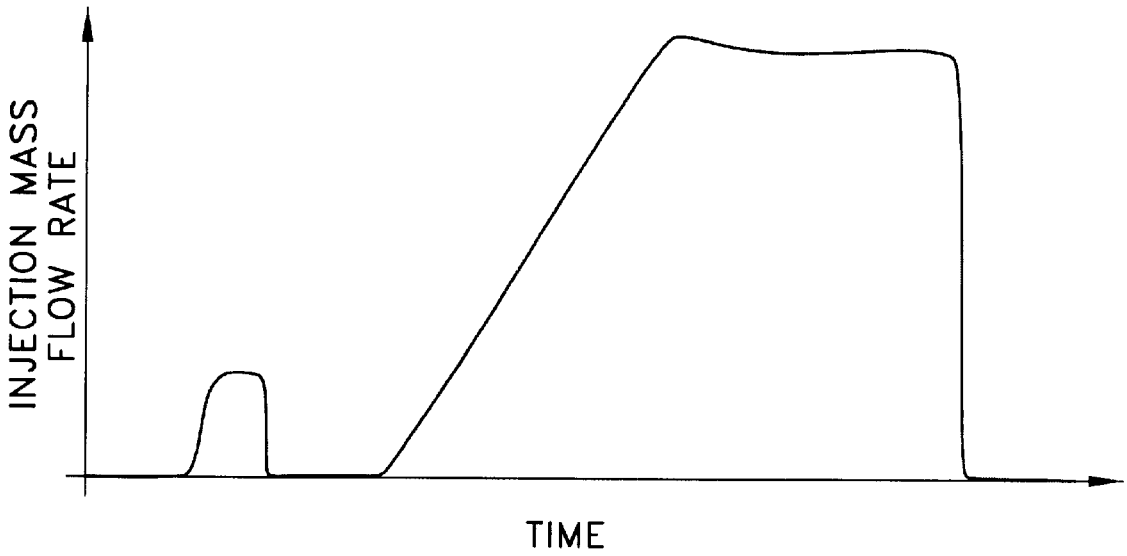
FIG. 3 is a graph of injection mass flow rate versus time for the example fuel injection event of FIG. 2.

The high pressure fuel entering fuel injector 10 at inlet 12 can be pressurized in a wide variety of known ways, including but not limited to hydraulic pressurization, cam driven pressurization, or even a high pressure reservoir fed by a high pressure pump. Between injection events, piezoelectric actuator 30 is de-energized, outlet control passage 25 is closed and needle valve member 40 is in its downward closed position. Each injection event is initiated by applying a desired voltage to piezoelectric actuator 30 that corresponds to a desired flow rate out of nozzle outlet 14. Referring now in addition to FIGS. 2 and 3, a split injection that includes a small pilot injection and a ramp shaped main injection is illustrated. As can be seen, the pilot injection event is accomplished by applying a relatively low voltage to piezoelectric actuator 30 for a brief amount of time. At this relatively low voltage, control valve member 31 lifts a known distance off of seat 26 to allow an amount of flow from needle control chamber 18 to low pressure area 28. This causes the pressure in needle control from needle control chamber 18 to low pressure area 28. This causes the pressure in needle control chamber 18 to drop relative to that in nozzle supply passage 15. This results in a net upward force on needle valve member 40 causing it to begin to lift. The needle valve member stops at a partially opened position when the various hydraulic and spring forces come to a new equilibrium, which is a function of the applied voltage on piezoelectric actuator 30. The pilot portion of the injection event is ended by de-energizing the piezoelectric actuator 30 for an amount of time.

The main injection event having a ramp shape is accomplished by again energizing piezoelectric actuator 30 with a steadily growing voltage. The needle valve member 40 responds by lifting in proportion to the applied voltage so that the flow area past needle seat 45 steadily grows to increase the mass flow rate out of nozzle outlet 14. The maximum flow rate is achieved when the flow area past seat 45 is about equal to the flow area out of nozzle outlet 14. At this point, the applied voltage remains constant for the remainder of the injection event. The injection is ended by abruptly dropping the voltage in piezoelectric actuator 30 to zero. This causes outlet control chamber 25 to abruptly close and the pressure in needle control chamber 18 to abruptly rise to equalize with that nozzle supply passage 15. This results in the hydraulic force acting on closing hydraulic surface 44 rising rapidly to quickly move needle valve member 40 downward to a closed position to end the injection event.

The above description is intended for illustrated purposes only and is not intended to limit the scope of the present invention in any way. For instance, while the illustrated embodiment uses pressurized fuel on both the opening and closing hydraulic surfaces of the needle valve, those skilled in the art will appreciate that a different fluid, such as pressurized lubricating oil, could be used on the closing hydraulic surface without otherwise altering the performance of the present invention. In addition, while the coupling linkage between the piezoelectric actuator and the needle valve member has been illustrated as being hydraulic, those skilled in the art will appreciate that other coupling linkages, such as mechanical and/or other hydraulic arrangements, could be employed and still have the ability to multiply the movement of the piezoelectric actuator into a larger movement of the needle valve member. Thus, those skilled in the art will appreciate that various modifications could be made to the illustrated embodiment without departing from the intended spirit and scope of the present invention, which is defined in terms of the claims set forth below.

What is claimed is:

1. A fuel injector comprising:

an injector body defining a nozzle outlet;

a needle valve member having a closing hydraulic surface and being mounted in said injector body and being movable a lift distance between an open position in which said nozzle outlet is open, and a closed position in which said nozzle outlet is blocked;

a piezoelectric actuator mounted in said injector body and being movable a piezo distance between an off position and an on position;

a coupling linkage interconnecting said closing hydraulic surface of said needle valve member to said piezoelectric actuator, and said coupling linkage multiplying movement of said piezoelectric actuator into a larger movement of said needle valve member; and said needle valve member being stoppable in a partially open position between said open position and said closed position when a predetermined voltage is applied to said piezoelectric actuator.

2. The fuel injector of claim 1 wherein said coupling linkage includes said injector body defining a needle control chamber; and said closing hydraulic surface is exposed to fluid pressure in said needle control chamber.

3. The fuel injector of claim 1 including a control valve member attached to said piezoelectric actuator and located adjacent a control valve seat defined by said injector body; and a flow area past said control valve seat being proportional to a positioning of said piezoelectric actuator.

4. The fuel injector of claim 1 wherein said injector body defines a nozzle supply passage and a needle control chamber; and said closing hydraulic surface being exposed to fluid pressure in said needle control chamber, and an opening hydraulic surface included on said needle valve member being exposed to fluid pressure in a nozzle supply passage.

5. The fuel injector of claim 1 wherein said lift distance is many times greater than said piezo distance.

6. The fuel injector of claim 1 wherein said needle valve member is held in said closed position at least in part by said coupling linkage when said piezoelectric actuator is in said off position.

7. The fuel injector of claim 1 wherein said needle valve member includes at least one outer opening hydraulic surface and an inner opening hydraulic surface that are exposed to different fluid pressures depending upon a positioning of said needle valve member.

8. The fuel injector of claim 1 wherein said injector body defines a needle control chamber;

said closing hydraulic surface being exposed to fluid pressure in said needle control chamber; and said fluid pressure in said needle control chamber being proportional to a positioning of said piezoelectric actuator.

9. A fuel injection system comprising:

a plurality of fuel injectors, each of said fuel injectors including an injector body that defines a nozzle outlet, a high pressure inlet and a low pressure drain;

a source of high pressure fuel being fluidly connected to each of said high pressure inlets and a low pressure reservoir being fluidly connected to each of said low pressure drains;

a needle valve member with a closing hydraulic surface being movably mounted in each of said injector bodies;

a piezoelectric actuator being movably mounted in each of said injector bodies;

a coupling linkage interconnecting said closing hydraulic surface of said needle valve member to said piezoelectric actuator, and said coupling linkage multiplying movement of said piezoelectric actuator into a larger movement of said needle valve member; and said needle valve member being stoppable in a partially open position when a predetermined voltage is applied to said piezoelectric actuator.

10. The fuel system of claim 9 wherein said coupling linkage includes said injector body defining a needle control chamber; and said closing hydraulic surface is exposed to fluid pressure in said needle control chamber.

11. The fuel system of claim 10 wherein said needle valve member is movable a lift distance;

said piezoelectric actuator is movable a piezo distance; and said lift distance is many times greater than said piezo distance.

12. The fuel system of claim 11 wherein said needle valve member includes at least one outer opening hydraulic surface and an inner opening hydraulic surface that are exposed to different fluid pressures depending upon a positioning of said needle valve member.

13. The fuel system of claim 12 including a control valve member attached to said piezoelectric actuator and being located in an outlet control passage that opens into said needle control chamber; and a control flow area from said needle control chamber into said outlet control passage being proportional to a positioning of said piezoelectric actuator.

14. The fuel system of claim 13 wherein a flow area past said needle valve member to said nozzle outlet being proportional to a voltage applied to said piezoelectric actuator.

15. A method of controlling an injection event comprising:

providing a fuel injector including a piezoelectric actuator and a needle valve member, wherein said piezoelectric actuator and said needle valve member are at least partially movably mounted in an injector body that defines a nozzle outlet;

interconnecting said piezoelectric actuator and a closing hydraulic surface of said needle valve member via a coupling linkage;

moving said needle valve member from a closed position in which said nozzle outlet is blocked to a partially open position in which said nozzle outlet is partially open, at least in part by applying a predetermined voltage to said piezoelectric actuator and multiplying movement of said piezoelectric actuator into a larger movement of said needle valve member with said coupling linkage;

directing fuel past said needle valve member to said nozzle outlet wherein a flow area past said needle valve member is proportional to a voltage applied to said piezoelectric actuator; and moving said needle valve member to said closed position, at least in part by reducing a voltage applied to said piezoelectric actuator.

16. The method of claim 15 including a step of moving said needle valve member to a fully open position at least in part by applying a voltage to said piezoelectric actuator that is greater than said predetermined voltage.

17. The method of claim 16 including a step of moving said needle valve member from said partially open position to said fully open position at least in part by raising a voltage applied to said piezoelectric actuator.

18. The method of claim 17 wherein said coupling linkage includes said injector body defining a needle control chamber; and exposing said closing hydraulic surface to fluid pressure in said needle control chamber.

19. The method of claim 18 including a step of varying a flow area past said needle valve member to said nozzle outlet at least in part by varying a voltage applied to said piezoelectric actuator.

20. The method of claim 19 including holding said needle valve member in said closed position when said piezoelectric actuator is in an off position at least in part by said coupling linkage.

* * * * *